US005110868A

United States Patent [19]

Bellis et al.

[11] Patent Number: 5,110,868

[45] Date of Patent: May 5, 1992

[54] BIODEGRADABLE COMPOSITIONS FOR CONTROLLED RELEASE OF CHEMICAL AGENTS

[75] Inventors: Harold E. Bellis, Wilmington, Del.; Virginia M. Osterman, Glen Mills, Pa.

[73] Assignee: E. I. Du Pont de Nemours and Company, Wilmington, Del.

[21] Appl. No.: 640,562

[22] Filed: Jan. 14, 1991

[51] Int. Cl.[5] ..... C11D 17/00; C11D 3/48

[52] U.S. Cl. ..... 252/174.23; 252/174.24; 252/174; 252/174.21; 252/174.22; 252/DIG. 2

[58] Field of Search ..... 252/174.23, 174.24, 252/174, 174.21, 174.22, DIG. 2

[56] References Cited

U.S. PATENT DOCUMENTS

| | | | |
|---|---|---|---|
| 4,269,723 | 5/1981 | Barford et al. | 252/106 |
| 4,772,802 | 2/1988 | Hutchings et al. | 252/174 |
| 4,986,353 | 1/1991 | Clark et al. | 166/279 |

*Primary Examiner*—Paul Lieberman
*Assistant Examiner*—Mary C. DiNunzio
*Attorney, Agent, or Firm*—Charles E. Krukiel

[57] ABSTRACT

Solid compositions comprising water degradable oligomers of hydroxyacetic acid and lactic acid having molecular weights of 800–4000 and containing 40–60 mole percent hydroxyacetic acid. The compositions are useful as controlled release agents for chemicals, especially as a toilet bowl cleaning component. Optional ingredients include dyes, fragrances, filler materials, surfactants, algicides, pest control agents, quaternary ammonium salts, and mixtures thereof.

12 Claims, No Drawings

BIODEGRADABLE COMPOSITIONS FOR CONTROLLED RELEASE OF CHEMICAL AGENTS

FIELD OF THE INVENTION

This invention relates to solid, water-degradable compositions comprising at least 50% by weight of certain thermoplastic oligomers of hydroxyacetic acid and lactic acid that dissolve over time in aqueous media at ambient temperature. More particularly, the invention is concerned with compositions employing as a matrix degradable amorphous oligomers of hydroxyacetic acid/lactic acid having molecular weights between about 800 to 4000 and containing 40 to 60 mole per cent of hydroxyacetic acid with the balance being lactic acid. The invention relates further to oligomeric compositions which permit the controlled release of effective concentrations of nonionic surfactants, dyes, chelants, oxidizing agents, perfumes, algicides, quaternary ammonium salts and inert fillers into water-containing reservoirs.

BACKGROUND OF THE INVENTION

Prior art on high molecular weight polymers for the slow release of drugs is extensive. Such polymers are normally encapsulated products that are used in nonaqueous systems and depend upon biodegradability to be effective. They are not effective in releasing materials into aqueous systems at ambient temperatures, i.e., 15°-60° C.

Low molecular weight oligomers have been claimed in U.S. Pat. No. 4,715,967 for release of hydroxyacetic acid/lactic acid from powders. The polymers function as plugs or filters and are used at temperatures above 150° C. No ingredients are claimed and the polymers are essentially crystalline containing greater than 85 per cent of hydroxyacetic acid, the balance lactic acid. The compositions of U.S. Pat. No. 4,715,967 have too slow a degradation rate to be used as a matrix. Their melting points are too high to be capable of blending chemicals without their degradation.

Polyester polymers of hydroxyacetic acid with lactic acid are taught by U.S. Pat. Nos. 4,387,769 and 4,526,695 as oil well treating agents. These polymers were extensively studied in the 1950s as possible textile fibers until it was found that they readily hydrolize in the presence of heat and water. They degrade in the presence of water at elevated temperatures like 150° C. and above in about one to seven days to form oligomers. These polyester polymers are expensive to manufacture and are of limited effectiveness in low temperature applications. Major problems in the control release art continues to be the inconsistency of dispensing rates and the erratic longevity of the cakes or blocks because of rapid and uneven dissolution resulting in decreased cake stability and longevity.

It is an object of the present invention to provide molded compositions comprising an oligomer binder which is water-degradable, environmentally acceptable, and resistant to fragmentation, which compositions are suitable for use for dispensing chemical agents at a controlled rate into toilet tanks or any other water-containing reservoirs, e.g., cisterns, lakes, ponds and pools, over extended periods of time and at ambient temperatures.

It is a further object of the present invention to provide solid unsupported compositions which comprise as a matrix certain hydroxyacetic acid/lactic acid polymer along with a dye, a fluorosurfactant, a quaternary ammonium salt and an inorganic salt.

Other objects, advantages and novel features of the present invention will be apparent to those skilled in the art from the following description and appended claims.

SUMMARY OF THE INVENTION

The objects of the invention are accomplished by providing a molded composition which comprises a water-degradable condensation polymer of hydroxyacetic acid and lactic acid and one or more nonionic surfactants, preferably including a fluorosurfactant, said polymer having a molecular weight of from about 800 to about 4000, and optionally one or more members of the group consisting of dyes, inert fillers, oxidizing agents, perfume, fragrances, chelants, algicides,quaternary ammonium salts and mixtures thereof. Advantageously, the compositions comprise from about 45-55% of said polymer, 5-10 of the surfactant component, 10-20% of the dye, 10-30% of the inert filler, and 0 to 5% of a quaternary ammonium salt.

In contrast to the compositions of the prior art, the compositions of our invention allow simple addition by dissolution or suspension in the polymer and are released by surface erosion of the additives rather than diffusion of the chemicals through the polymer and into the solution. A temperature as low as 70° C. is satisfactory in blending of the reagents to make the cake or mold. This also minimizes the occurrence of reactions between the components. The natural inertness and quality of the chemical reagents will, of course, determine the suitable melt temperature to use. The melt is allowed to solidify in a suitable mold for use, e.g., a hockey puck design.

It has been found that the polymer can be cast in polymer molds that subsequently become the package. A composite film of Mylar® polyethylene terephthalate and polyethylene is a suitable material. This film excludes water absorption during storage.

For purposes of uniform release of chemicals, it is desirable that the shape have a surface area to thickness area ratio of greater than 10.

To enhance the breakdown of the polymer it has been found that incorporation of certain quaternary ammonium halides, called phase transfer catalysts, enhance the breakdown of the polymer under normal use conditions.

In the practice of the present invention, chemicals can be added individually to the oligomer or in concert. Thus, one can utilize one solid with all chemicals to be added or several solids with separate components to achieve the desired result. The use of several solids is useful for release of incompatible chemicals. It also reduces the time required to find suitable compositions.

Surprisingly, we have found that nonionic fluorosurfactants such as, for example, "Zonyl" FSN, a paste whose primary ingredient is telomer B monoethylene glycol and whose formula is $F(CF_2CF_2)_3$-$_8CH_2CH_2O(CH_2CH_2O)_xH$, in our oligomer matrix can be released and absorbed on ceramic tile to leave a residue film that contains detectable levels of fluorine. This fluorine is not removed by ordinary circulation of water as in the flushing of a toilet. Its build-up and presence make for a low energy surface that will resist staining. It is expected that the film is only a monolayer thick. Experiments have shown that build-up of fluorine with time occurs as coverage increases. "Zonyl" FSN is particularly preferred for the reason that it foams, allowing the tank or pond surface above the surface of the tank water to be wetted by a cleaning agent.

These added solutions are very dilute in nature (ppm). It is to be understood that in many cases the added reagents need to be effective at such levels to produce desired effects.

Unexpectedly, we have found that certain oxidizing agents can be incorporated in our oligomeric compositions and release active oxygen on dissolution. A solid disc containing 40% Oxone ® (sodium monopersulfate) has been prepared and found to be stable.

A feature that the compositions of the present invention exemplify is complete dissolution in aqueous media with time. The compositions are environmentally safe, leave no residues and are free of phosphates.

It is critical in the present invention that the hydroxyacetic acid and lactic acid oligomer-polymer mixture which is utilized in the formation of the cake composition be prepared using a 1 to 1 monomer ratio so as to give a polymer that is amorphous and low melting, i.e., in a melting range below 100° to allow processing. To insure zero amount of crystallization, i.e., 100% amorphous polymer, the quantity of hydroxyacetic acid in the polymer should be equal to the lactic acid. The amount of hydroxyacetic acid in the polymer can vary from 30 to 70 mole %, preferably 55–45 mole %. The molecular weight of the oligomer/polymer should be in the range of 800–4000 in order to achieve proper solubility. The oligomer/polymer which is the primary binder component of the invention is water-insoluble and is biodegradable. The oligomer/polymer is a polyester which reacts with water, i.e., the water attacks the ester bond to give carboxylic acid and alcohol, breaking down to smaller units of the oligomer/polymer. The smaller units of the oligomer/polymer, i.e., monomers, dimers, and trimers are water soluble. In addition to water, the oligomer/polymer may be degraded by sunlight and bacterial microorganisms.

DETAILED DESCRIPTION OF THE INVENTION

According to the present invention, it has been found that biodegradable solid compositions useful as controlled release agents can be achieved provided certain oligomer/polymers of hydroxyacetic acid and lactic acid (50–50 monomer ratio) are employed as binders. The oligomers range in molecular weight from 800 to 2400 and are prepared by condensation polymerization of hydroxyacetic acid and lactic acid. Preferably, the lactic acid is L- or DL-lactic acid. Oligomers having molecular weights outside the indicated molecular weight range have been found unsatisfactory for use in the formulations of our invention inasmuch as the resulting products lack integrity, fragment readily, and release chemicals in a non-uniform manner. The binder content of the compositions of our invention can range between 45 and 80 weight percent.

In order to improve the cake characteristics and to speed up hydrolysis of the compositions, it has been found advantageous to utilize in the compositions binders prepared by using DL-lactic-acid.

It has also been found to be particularly advantageous to utilize certain nonionic surfactants, particularly those containing fluoro ingredients, in the compositions of the present invention. As pointed out above, a preferred fluorosurfactant is FSN-100. Among the nonionic surfactants that may be employed are the condensation products of a long chain ethylene oxide moiety with an aliphatic alcohol, preferably a primary or secondary aliphatic alcohol or alkyl phenol, preferably the primer or secondary alcohol contains 8 to 20 carbon atoms and the alkyl phenol-based moiety is one wherein the alkyl chain is straight or branched and contains 6 to 12 carbon atoms, preferably 6 to 9 carbon atoms.

Illustrative nonionic surfactants having desired characteristics which are available on the market are sold under the trade names of "Zonyl", "Merpol" and "Triton".

Water-soluble inert salts are used in the compositions of the invention as filler materials so that the composition can be formed into solid objects of desired sizes, shapes and designs without using excessive amounts of active ingredients. They are used in amounts of from 10 to 30%. The salts which can be used to advantage in the compositions are limited, the preferred salt being sodium chloride. While calcium sulfate, because of its low cost, might be thought to be a candidate, we have found that it is not entirely satisfactory because the cake composition containing it fragments excessively. However, the cake possesses good color. Calcium carbonate may be useful as an adjuvant when one wants a product that floats in water. A porous product formed by gas dispersion during solidification will also make a low density product. This feature may be advantageous, for example, when one wants to release a chemical such as an algicide near or on the surface of a pond or pool.

The compositions of the invention can contain from 10 to 20% of a dye. Examples of suitable dyes are Acid Blue No. 9, Carta Blue V (C.I.24401), Acid Green 2G(C.I.42085), Astragon Green D(C.I.42040), Maxilon Blue 3RL(C.I. Basic Blue 80), Drimarine Blue Z-RL (C.I.Reactive Blue 18), and other Acid Blue 9 type dyes.

The compositions of the invention may also contain from 5–10% by weight of a cationic quaternary ammonium salt. Specific examples of such salts that may be used in the compositions of the invention include cetyl trimethyl ammonium bromide, octadecyl dimethyl ethyl ammonium bromide, cetyl dimethyl ethyl ammonium bromide, octadecenyl-9-dimethyl ethyl ammonium bromide, dioctyl dimethyl ammonium chloride, dodecyl trimethyl ammonium chloride, octadecyl trimethyl ammonium chloride, octadecyl trimethyl ammonium bromide, hexadecynyl trimethyl ammonium iodine, octyltrimethyl ammonium fluoride, and mixtures thereof. These compounds can function as phase transfer catalysts and promote oligomer dissolution.

The compositions of our invention may also contain perfumes to impart an acceptable odor to the water being treated. The perfume may be in solid form and is suitably present in an amount up to 0.1% or higher by weight. In this connection, it may be noted that the term "perfume" is intended to refer to any material giving an acceptable odor, and thus materials giving a "disinfectant" odor such as essential oils, pine extracts, terpinolenes, ortho phenyl phenol or paradichlorobenzene may be employed. The essential oils and pine extracts also contribute as plasticizers and are functional to a degree in extending puck life.

The blocks or pucks of the present invention can be produced by a variety of process, e.g., casting, tableted with pressure or extruded to final form. The melt casting process is preferred and is well within the skill of those in the art. It involves the melting of the ingredients and then casting the melt into appropriate shaped molds and allowing the melt to cool and solidify. The shaped molds or tablets each suitably having a weight of from about 20 to 70 grams, preferably about 25 grams.

The geometry of the mold, block, cake or puck is important. Preferably the top surface of the block should be substantially larger in area than a side surface which aids the compositions of the invention to dissolve in the reservoir in a sheet-like fashion—one layer at a time. It is to be understood, however, that while the puck can be in most any shape, such as oval, round or star-like, the area of its top surface as pointed out above should be at least 10 times the area of the side surface.

Among the uses to which the compositions of the present invention can be put include release of growth hormones into water-containing, fish-feeding tanks, release of such chemicals as sodium hydroxide or thioglycolic acid to remove hair in bathroom sink traps, release of hypochlorite/oxygen into pools or tanks for potable water, release of pest control agents onto ponds, lakes and other water-containing reservoirs. Those compositions of this invention which contain polymer, inert filler, dye, surfactant and quaternary ammonium salt, are particularly useful as toilet bowl cleaning materials.

It is to be understood that dissolution of the oligomeric matrix in the practice of our invention generates hydroxyacetic acid, which is known to prevent the formation of calcium and magnesium carbonates from hard water. Thus, the presence of white films in showers and tubs which are due to carbonate deposits in areas where hard water is prevalent is minimized by use of our invention.

In order that the invention may be better understood, the following examples are given by way of illustration only. In the examples, all parts and percentages are by weight unless otherwise stated.

The following examples are for compositions suited for forming shaped bodies or blocks by a casting/molding operation.

EXAMPLE 1

The biodegradable oligomer/polymer of hydroxyacetic acid and lactic acid suitable for use as a matrix in formulating the compositions of the invention is prepared as follows:

300 grams (3.94 moles) of hydroxyacetic acid and 336 grams (373 moles) of lactic acid are mixed and heated to 190° C. to condense the acids and eliminate water. After heating the mixture for a period of three hours at 190° C. and atmospheric pressure, the pressure is reduced to 5 mm of mercury and heating is continued for another 2 hours at 210° C. A polymer melting at 85° C. is produced with a molecular weight of 1600 in a yield of about 90%. In this Example, the polymer contains 51 mole percent of hydroxyacetic acid and 49 mole percent of L-lactic acid.

The polymer prepared as described above is remelted at 80°–100° C. To it are added an nonionic surfactant consisting of 4 parts of "Triton" and 1 part "Zonyl" FSN in an amount of 5% based on the total weight of the composition, a blue dye in the amount of 20%, sodium chloride in the amount of 24% and 1% quaternary ammonium bromide. The ingredients are mixed and the blended mixture while maintained above 80° C. is poured into a plastic mold with a rosette shape. The resulting solid cake (puck) weighing about 25 grams is tested in toilet bowls and found to last about 4 weeks with generation of blue color in the bowl. The surfactant is released at a controlled rate due to the breaking down of the oligomer/polymer to smaller units by reaction between water and the oligomer/polymer.

EXAMPLE 2

Following the procedure of Example 1, a shaped toilet bowl cleaning composition is prepared with the following ingredients:

50% oligomer of hydroxyacetic acid and lactic acid (Mol. Wt. 2100)
15% Blue Dye
30% Sodium Chloride
4% "Triton" X-100
1% "Zonyl" FSN-100

EXAMPLE 3

Following the procedure of Example 1, a shaped toilet bowl cleaning composition is prepared with the following ingredients:

50% hydroxyacetic acid/lactic acid copolymer
20% Blue Dye
24% Sodium Hydroxide
1% Cetyltrimethylammonium bromide
4% "Merpol" HCS (alcohol ethoxylate, 5–15% hexylene glycol and 25–35% water)
1% "Zonyl" FSN-100

EXAMPLE 4

Following the procedure of Example 1, a shaped toilet bowl cleaning composition is prepared with the following ingredients:

50% oligomer/polymer prepared by condensing hydroxyacetic acid and DL-lactic acid (Mol. Wt. 1400)
15% Blue Dye
30% Sodium Chloride
4% "Triton" X-100
1% "Zonyl" FSN-100

EXAMPLE 5

Following the procedure of Example 1, a shaped toilet bowl cleaning composition is prepared with the following ingredients:

50% oligomer/polymer prepared by condensing hydroxyacetic acid and DL-lactic acid (Mol. Wt. 1800)
15% Blue Dye
24% Sodium Chloride
1% Cetyltrimethylammonium bromide
4% "Merpol" HCS
1% "Zonyl" FSN-100

Good dye release was observed over a multiple week test of the above Examples 2 to 5.

To determine the extent of "polytetrafluoroethylene-type protection imparted to toilet bowls by compositions in puck form containing the above ingredients, ceramic chips are placed in toilet simulators. At various degradation points over a period of 60 days "fluorine testing" is performed by means of X-ray fluorescence. Counts per second (CPS) which can be calibrated in parts per million are measured. After exposure of 39 days, the CPS reading is 23, which prior to exposure was zero.

EXAMPLE 6

A 25 gram shaped solid was prepared by adding Oxone® (sodium monopersulfate) to a 50% oligomer prepared by condensing hydroxyacetic acid and DL-lactic acid (MW 1800). The polymer matrix released 1–10 ppm active oxygen into water held at 40° C. over a 4-week period. It is to be understood that other peroxygen compounds such as sodium perborate can be used in place of Oxone® for the purpose of releasing active oxygen. This illustrates its potential use in the treatment of pools and spas.

We claim:

1. A solid, water-degradable composition in the form of a molded object which is amorphous and comprises at least 50 percent by weight of or amorphous condensation polymer of hydroxyacetic acid and lactic acid, said polymer having a molecular weight of between about 800 and 4000 and composed of 40 to 60 mole percent of hydroxyacetic acid, the balance being lactic acid, from about 5 up to about 10 weight percent of a nonionic surfactant which is a condensation product of a long chain ethylene oxide moiety with an aliphatic alcohol, wherein the aliphatic alcohol contains 8 to 20 carbon atoms, and the balance comprising at least one water soluble inert salt.

2. The composition of claim 1 in which the nonionic surfactant is a fluorosurfactant.

3. The composition of claim 1 further comprising from about 5 up to about 10 weight percent of a cationic quaternary ammonium salt.

4. The composition of claim 1, claim 2, or claim 3 which includes from about 10 up to about 20 percent by weight of a dye.

5. A water-degradable cleaning composition for the controlled release of chemical agents comprising 45–55% by weight of an amorphous 40 to 60 mole percent hydroxyacetic acid/60 to 40 mole percent lactic acid condensation polymer with a molecular weight of from about 800 up to 2400, 5–10% by weight of a nonionic surfactant which is a condensation product of a long chain ethylene oxide moiety with an aliphatic alcohol, wherein the aliphatic alcohol contains 8 to 20 carbon atoms 10–20% by weight of a dye, 10–30% by weight of an inert filler which is a water-soluble inert salt, and 0–5% by weight of a cationic quaternary ammonium salt.

6. The composition of claim 5 wherein the nonionic surfactant is a fluorosurfactant having the chemical formula $F(CF_2CF_2)_{3\text{-}8}CH_2CH_2O(CH_2CH_2O)_xH$.

7. The composition of claim 5 wherein the polymer has a molecular weight of from 1400 to 1800 and is prepared by condensing hydroxyacetic acid with L-lactic acid in a 1 to 1 monomer ratio.

8. The composition of claim 5 wherein the polymer has a molecular weight of about 1000 to 1400 and is prepared by condensing hydroxyacetic acid and DL-lactic acid in a 1 to 1 monomer ratio.

9. The composition of claim 5 wherein the water-soluble inert salt is sodium chloride.

10. A toilet bowl cleaning composition in the form of a molded object which is amorphous comprising 50% by weight of a 40 to 60 mole percent hydroxyacetic acid/60 to 40 mole percent L-lactic acid polymer with a molecular weight of about 2100, 15% by weight of a blue dye, 30% by weight Sodium chloride, 4% by weight of a nonionic fluorosurfactant, and 1% by weight of a fluorosurfactant having the formula $F(CF_2CF_2)_{3\text{-}8}CH_2CH_2O(CH_2CH_2O)_xH$.

11. A composition of claim 1 containing a solid peroxygen compound.

12. A composition of claim 11 in which the solid peroxygen compound is sodium monopersulfate.

* * * * *